US011051583B2

(12) United States Patent
Choi

(10) Patent No.: US 11,051,583 B2
(45) Date of Patent: Jul. 6, 2021

(54) NON-SLIP SHOES WITH WEBFOOT

(71) Applicant: GTS GLOBAL CO., LTD., Gyeonggi-do (KR)

(72) Inventor: Seon-Mi Choi, Gyeonggi-do (KR)

(73) Assignee: GTS GLOBAL CO., LTD., Gyeonggi-Do (KR)

( * ) Notice: Subject to any disclaimer, the term of this patent is extended or adjusted under 35 U.S.C. 154(b) by 381 days.

(21) Appl. No.: 15/780,034

(22) PCT Filed: Dec. 14, 2015

(86) PCT No.: PCT/KR2015/013648
§ 371 (c)(1),
(2) Date: May 30, 2018

(87) PCT Pub. No.: WO2017/094953
PCT Pub. Date: Jun. 8, 2017

(65) Prior Publication Data

US 2020/0297074 A1 Sep. 24, 2020

(30) Foreign Application Priority Data

Nov. 30, 2015 (KR) ..... 10-2015-0169411

(51) Int. Cl.

| | |
|---|---|
| ***A43B 13/22*** | (2006.01) |
| ***A43B 5/08*** | (2006.01) |
| ***A43B 3/00*** | (2006.01) |
| ***A43B 13/14*** | (2006.01) |
| *A63B 31/11* | (2006.01) |

(52) U.S. Cl.
CPC ..... *A43B 13/22* (2013.01); *A43B 3/0036* (2013.01); *A43B 5/08* (2013.01); *A43B 13/145* (2013.01); *A43B 13/146* (2013.01); *A63B 31/11* (2013.01)

(58) Field of Classification Search
CPC ..... A43B 3/0036; A43B 13/22; A43B 5/08; A63B 2031/112; A63B 2031/115; A63B 31/11
USPC ..... 36/8.1
See application file for complete search history.

(56) References Cited

U.S. PATENT DOCUMENTS 3,043,025 A * 7/1962 Semon ..... A43B 13/223 36/59 R
3,237,322 A * 3/1966 Santore ..... A43B 13/223 36/590
4,118,878 A * 10/1978 Semon ..... A43B 13/203 36/59 C (Continued)

FOREIGN PATENT DOCUMENTS

CN 202051037 U 11/2011
CN 202190820 U 4/2012

(Continued)

OTHER PUBLICATIONS

International Search Report for PCT/KR2015/013648 dated Sep. 27, 2016.

*Primary Examiner* — Ted Kavanaugh
(74) *Attorney, Agent, or Firm* — The PL Law Group, PLLC

(57) ABSTRACT

The present invention relates to shoes which are an excellent fit and have improved comfortability and safety in use particularly in a wet place, and provides non-slip shoes with a webfoot in which a sole part and a webfoot part are integrally formed, thereby allowing walking and swimming at the same time.

10 Claims, 5 Drawing Sheets

(56) References Cited

U.S. PATENT DOCUMENTS

| | | | | | |
|---|---|---|---|---|---|
| 5,266,062 | A * | 11/1993 | Runckel | A63B 31/11 | 36/8.1 |
| 5,795,204 | A * | 8/1998 | Bruner | A63B 31/11 | 441/61 |
| 5,924,902 | A * | 7/1999 | Burns | A63B 31/11 | 441/64 |
| 6,663,452 | B1 | 12/2003 | Myers | | |
| 7,055,265 | B1 * | 6/2006 | Bathum | A43B 5/08 | 36/11.5 |
| D540,516 | S * | 4/2007 | Weitzman | D2/951 | |
| 7,601,041 | B2 | 10/2009 | McCarthy | | |
| 8,333,020 | B1 * | 12/2012 | Sanchez | A63B 31/11 | 36/8.1 |
| 10,478,672 | B1 * | 11/2019 | Reyes | A43B 5/08 | |
| 2010/0029152 | A1 * | 2/2010 | Fraser | A43B 5/08 | 441/64 |
| 2016/0346619 | A1 * | 12/2016 | Salcido | A63B 31/11 | |

FOREIGN PATENT DOCUMENTS

| | | | |
|---|---|---|---|
| CN | 202222538 | U | 5/2012 |
| CN | 105054476 | A | 11/2015 |
| JP | 3737377 | B2 | 1/2006 |
| KR | 2000-0009856 | U | 6/2000 |
| KR | 2003-0081266 | A | 10/2003 |
| KR | 10-0493138 | B1 | 6/2005 |
| KR | 20-0398877 | Y1 | 10/2005 |
| KR | 20-2007-0000250 | U | 3/2007 |
| KR | 10-2013-0001401 | A | 1/2013 |
| KR | 10-1453488 | B1 | 10/2014 |
| KR | 10-2014-0141389 | A | 12/2014 |
| KR | 20-2012-0006266 | U | 9/2016 |

* cited by examiner

NON-SLIP SHOES WITH WEBFOOT

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2015/013648, filed on Dec. 14, 2015, which claims priority to the benefit of Korean Patent Application No. 10-2015-0169411 filed in the Korean Intellectual Property Office on Nov. 30, 2015, the entire contents of which are incorporated herein by reference.

TECHNICAL FIELD

Example embodiments of the invention relate to shoe. More particularly, example embodiments of the invention relate to a non-slip shoe with a webfoot.

BACKGROUND ART

Generally, shoes are designed to reduce impact of walking and protect foot of pedestrians from outside, and most people wear the shoes when walking.

These shoes generally formed by combining a midsole at a bottom side corresponding to a shape of the foot with an upper part to cover the foot at a top side.

Recently, as consumers are interested in fashion and health, various types, shapes, or materials for shoes are proposed. A representative material of shoes may be leather, fiber, synthetic resin, etc.

When the shoes are made of leather, it maintains its shape relatively well, so it does not change its shape even though it is worn. However, it has difficulty to wear and it has not only frequent damage to heel or toe according to walking, but also weakness in ventilation.

When the shoes are made of fiber or synthetic resin which is relatively soft material, it is comfort to wear, but there is a problem that deformation occurs and durability is weak as time goes on.

Although various attempts have been made to overcome the disadvantages as described above, it is very difficult to satisfy both convenience of wearing, durability, and comfort of walking on the foot.

In recent years, there is a need of shoes which are made of a material having a relatively small thickness and high ductility and is intended to be conveniently used in a swimming pool or a beach.

However, these shoes are focused on water resistance function so that moisture inside may deteriorate wearing filling. And, it is often used in a place with a lot of water and there is a problem of safety accident due to slipping.

Korea public utility model publication KR 20-2000-0009856 discloses Non-slip shoe with webfoot. The shoe is designed to detachably attach the webfoot to perform two functions simultaneously as shoes and webbing. However, the structure is complicated and not robust, so that the two functions are not smoothly performed and it is not practical.

SUMMARY

One or more example embodiment of the invention provides a non-slip shoe with a webfoot which guarantees underwater and coastal walking, water playing while wearing, and improves safety when walking on a wet floor.

According to an example embodiment of the invention, a non-slip shoe includes an upper part (100) which covers an instep of a foot, an insole (200) connected to a lower side of the upper part, an outsole (300) combined with the insole and the upper part which is supported by a floor, and a webfoot (360) which extends from a front side of the outsole. The outsole gradually may rise at a forefoot portion to be spaced from the floor. The non-slip shoe may further include a cup portion which is in close contact with the floor on an outer circumferential side, and is compressed and provides a suction force. the suction portion may include a cup portion having a protrusion protruding downward from a center of the cup portion. Accordingly, it can be used both on land and water.

In an example embodiment, an outer periphery of the cup portion may be disposed below lower end of the protrusion. Thus, the performance of suction is maximized.

In an example embodiment, in the outer periphery of the cup portion may make contact with the floor and be compressed so as to provide suction force when the cup portion makes contact with the floor. The protrusion may come into contact with the floor, and the suction force of the cup portion may be released as the pressure increases, when a foot load moves. Therefore, it is possible to reduce the sense of heterogeneity at the time of walking.

In an example embodiment, the webfoot may include a plurality of the reinforcing rib which is a protrusion is formed by protruded downward from a bottom surface of the webfoot at predetermined intervals to divide space left and right to guide a flow of water backward. A plurality of grooves or protrusions may be formed laterally to guide the flow of water to sideward at a side surface of the reinforcing rib disposed on outermost side of the webfoot.

In an example embodiment, the outsole may further include at least one friction portion (370) formed to be long along a front-rear direction, and the suction portion further comprises a through hole (313) formed at the center of the cup portion and discharging moisture inside to outside. The suction portions may be arranged on the outer side of the friction portion. Therefore, the suction performance, drainage and friction performance are maximized.

In an example embodiment, the outsole may include a webfoot further including a friction portion radially formed on a heel portion.

According to the present invention, the functions of walking and swim can be simultaneously performed, thereby improving the utility in the water and maximizing the convenience since the webfoot do not obstruct walking.

DETAILED DESCRIPTION

Hereinafter, the invention will be explained in detail with reference to the accompanying drawings.

In the present invention, a shoe with a webfoot, a non-slip structure, and a structure for drainage to be used in places such as watery rivers, swimming pools, beaches, etc. is provided.

A non-slip shoe with a webfoot according to the present inventive concept basically includes a outsole which is disposed at a bottom and has an suction structure for non-slip to a floor, an upper part which covers an upper side of the outsole, a webfoot which extends toward a front side of the outsole and increases resistance to a current of water.

The outsole may be formed in various shapes and sizes depending on a type of the shoe. The concept of the present invention is not limited to the description and drawings described below. In the description of the present invention, when both feet are facing to each other, a direction to face each other is defined as inside, and a direction opposite to the inside is defined as outside.

Figure 1:
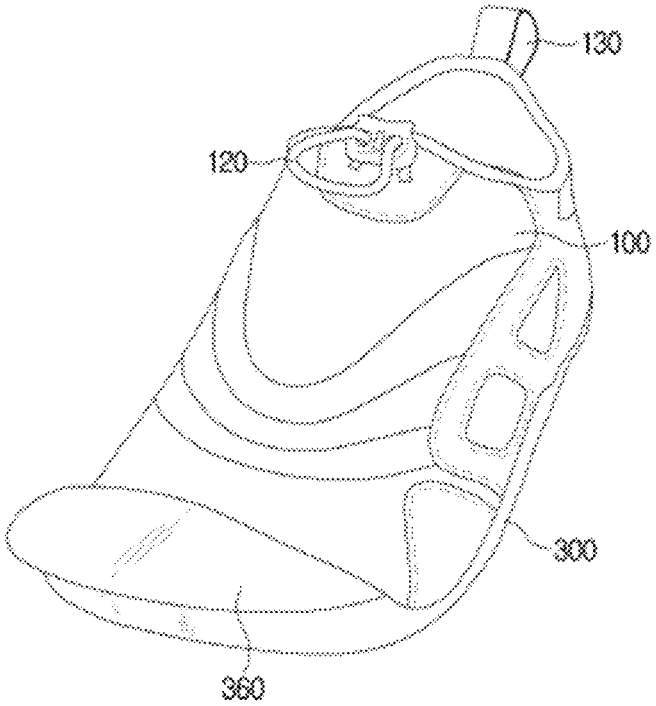
FIG. 1 is a perspective view illustrating a non-slip shoe with a webfoot according to an example embodiment of the invention.

FIG. 1 is a perspective view illustrating a non-slip shoe with a webfoot according to an example embodiment of the invention.

The present invention includes an upper part 100, an insole and an outsole 300.

The outsole 300 is disposed configured to support a bottom of foot to upper side and make contact to the floor to bottom side. The outsole 300 may be made of natural rubber or synthetic rubber to improve frictional force, but is not limited thereto.

Since a concept of the present invention suggests that materials constituting the whole shoe are made lighter than conventional shoes, materials of the outsole 300 may be selected from a synthetic resin material, thermo plastic elastomers (TPE), natural rubber, and synthetic rubber that can be injection-molded.

The outsole 300 supports the overall structure and preferably has a higher durability than other parts. Thus, the outsole 300 is thicker than the upper part 100 and the insole (refers to 200 of FIG. 6).

The outsole 300 may be divided into a bottom portion supporting the floor and a sidewall portion surrounding lower side of the upper part 100. The side wall portion may have a shape that is raised and recessed upward and downward for the purpose of reinforcing the lightweight shoe.

In order to improve activity and safety of the wet or slippery floor, the outsole 300 includes a suction structure at a bottom. The suction structure may be a kind of vacuum suction cup. A preferred embodiment thereof will be described later.

The upper part 100 is formed as a whole wrapping around the foot, and an opening portion (reference numeral not shown) through which the foot can enter and exit may be formed at upper side. In order to satisfy the concept of the lightweight shoe of the present invention, it is preferable that the material of the upper part 100 is made of a lightweight material excellent in stretchability, such as Neoprene material or Polyspan material can be used in consideration of elasticity. In addition, it is preferable that the upper part 100 may be formed in a mesh form so that water can pass partly or entirely.

A side wall portion of the outsole 300 may include a portion protruding upward at a forefoot portion and a portion protruding upward at a heel portion An extension portion 130 further protruding upward may be disposed at a rear side of the upper part 100. The extension portion 130 can be gripped by hand and may be shaped like a ring to enhance ease of shoe removal.

In addition, a ring portion (140 in FIG. 6) may be further disposed at the opening portion of the upper part 100 where the foot is taken in and out, so as to surround upper end of the opening portion to prevent damage due to repeated use.

A webfoot 360 is formed at front side of the outsole 300 so as to function as webbing. In consideration of durability and manufacturing convenience, the webfoot 360 and the outsole 300 are preferably integrally formed by casting or injection molding. The webfoot 360 may increase friction area with the water during walking or swimming in water, thereby improving mobility in the water. Accordingly, it can be used both on land and water. Although size and shape of the webfoot 360 may be variously selected depending on the selection, it is preferable that the shape is a stepped shape to the upper side so as not to disturb walking on the land, and it is preferable that the size not to contact the floor with the ends of the webfoot 360 even if there is a tilting or bending deformation of the shoes due to walking.

Meanwhile, the tightening part 120 may be formed adjacent to the opening portion of the upper part 100. The tightening part 120 tightens the ankle part to prevent the shoe from being detached when the webfoot 360 receives resistance underwater. The tightening part 120 is configured to surround a part of the foot or ankle. The tightening part 120 may include a wire (not shown) disposed inside the upper part 100 and a fixing member (not shown) for fixing a tension of the wire at the outside.

Figure 2:
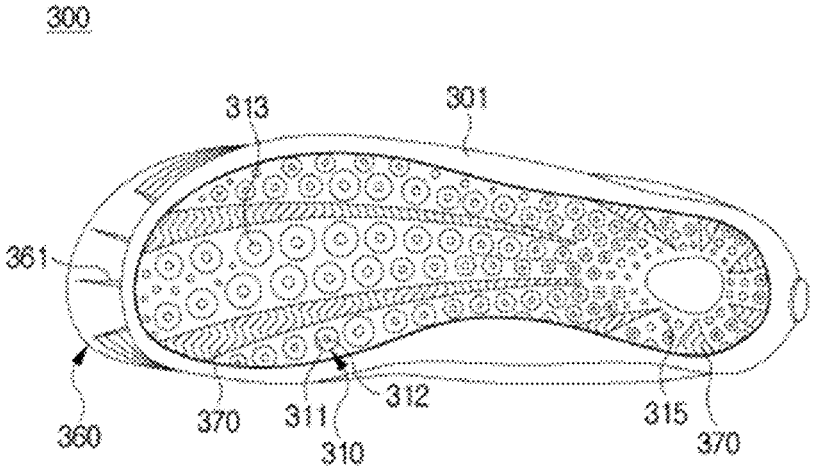
FIG. 2 is a bottom view illustrating a non-slip shoe with a webfoot according to a first example embodiment of the invention.

FIG. 2 is a bottom view illustrating a non-slip shoe with a webfoot according to a first example embodiment of the invention.

It should be noted that although the bottom surface is shown as a reference for convenience in the present embodiments, it should be noted that the outsole 300 is in contact with the floor as shown in FIG. 1

As described above, it is preferable for safety and the activity to have a predetermined friction structure in a watery environment such as a swimming pool, and the friction force may be provided by a vacuum suction.

Therefore, the outsole 300 may have a plurality of suction portions 310 at the bottom thereof. The suction portion 310 is an upward concave cup to function as a vacuum suction.

When a load of the body is provided on a bottom of the foot, the suction portion 310 is extended toward outer circumference and compressed downward, and inside air is exhausted due to the pressure. Accordingly, suction force can be applied to the floor by a negative pressure of the suction portion 310. The suction force can be further enhanced by the water layer disposed on the floor.

The side wall portion 301 may be formed in the form of wrapping the outer periphery of the bottom surface of the outsole 300, and may form an outer frame on the bottom surface. This form is preferably formed as a whole by an integral molding.

Area of contact with the floor is mainly the suction portions 310. For this purpose, it is preferable that the suction portion 310 is disposed in a manner protruding downward from the overall structure. Accordingly, the suction portion 310 includes a cup portion 311 formed in an upwardly concave disc shape. The cup portion 311 forms a vacuum between an inner space and the floor to provide a suction force as described above.

However, discomfort can be solved by considering release of the suction force when walking. An additional configuration for releasing the suction force is proposed. The configuration for releasing the suction force may be a protrusion 312 protruding downward from a center of the cup portion 311.

It is preferable that outer peripheral side of the cup portion 311 is formed to extend further downward than the protrusion 312. According to this configuration, when a predetermined portion of the outsole 300 starts to contact the floor by walking, it is first brought into close contact with the floor from the outer circumferential side of the cup portion 311. And then, as the pressure is applied, the cup portion 311 is compressed and deformed, and air is exhausted, and the suction force is provided between the floor and the bottom of the cup portion 311. And then, as bigger pressure is applied, the protrusion 312 disposed on the center of the cup portion 311 is moved downward and is brought into contact with the floor, so that the suction force can be released by pushing the floor while compressing remaining air inside the cup portion 311.

The reason for this is that slippage on the wet floor occurs at a moment when the shoe comes into contact with the floor and a water layer is formed between the shoe and the floor. Due to the configurations above in a process of continuously contacting the floor, the suction force is generated by the cup portion 311 during contacting and initial pressure provided, and the protruding portion 312 is further moved downward to naturally release the suction force during movement contact portion with the floor for movement of the load.

Although the suction portion 310 may be formed on the bottom surface of the entire outsole 300, it is preferable to form a shape that covers a region of the forefoot in which a load is heavily loaded on the sole. A more preferable structure for this purpose will be described.

The suction portion 310 may be arranged on the bottom surface mainly about the forefoot. The protrusion 312 may be omitted and a through hole 313 may be formed at the cup portion 311 which is disposed in substantially central portion along a width direction. The through hole 313 may be formed to pass through the upper and lower surface of the outsole 300. When the insole 200 is made of a material or a shape capable of passing water, it can function to discharge the water inside to outside. Above mentioned structure may function to effectively discharge water flowed inside, as it moves while swirling in the water, to outside. In addition, the through hole 313 can function as a temporary storage space that can contain a certain amount of moisture so that an excessive water layer is not generated between the floor and the cup portion 311 during the suction process.

At this time, the suction portion 310 or the cup portion 311 is mainly configured to closely contact with the floor. If an excessive water layer is generated, countermeasures may be required. For this, the outsole 300 may have a friction portion 370 on its bottom surface, and the friction portion 370 may have a concavo-convex pattern having a drainage groove. As shown in the drawing, the friction portion 370 is formed by serially arranging grooves in a zigzag form, and it is preferable that the friction portion 370 is elongated in the front-rear direction in consideration of a walking direction.

In the first embodiment of the present invention, with respect to the width direction, the friction portions 370 are spaced apart from each other and extend in the front-rear direction, the cup portion 311 having the through hole 313 is disposed therebetween, and the suction portion 310 having the protrusion 312 is formed mainly in an area between the friction portion 370 and the side wall portion 301.

Accordingly, the suction portion 310 mainly on the outer peripheral side performs suction function by vacuum pressure with the floor, the cup portion having the through hole 313 in the center is for discharging moisture, and the friction portion 370 dividing them perform improving frictional force with the floor and drainage. It is advantageous that the friction portion 370 is radially disposed at the heel portion as shown.

The webfoot 360 extends from a front side of the outsole 300. A reinforcing rib 361 for structural reinforcement is formed in front-rear direction. The reinforcing ribs 361 may be formed in a shape of protrusion protruded downward from a bottom surface of the webfoot 360. Accordingly, a space is defined between the reinforcing ribs 361 so that water can be discharged backward.

On the other hand, on a side surface of the reinforcing rib 361 disposed on outermost side, a plurality of grooves or protrusions formed in a lateral direction are formed so that water can be guided to the side, thereby water resistance cane be reduced.

Figure 3:
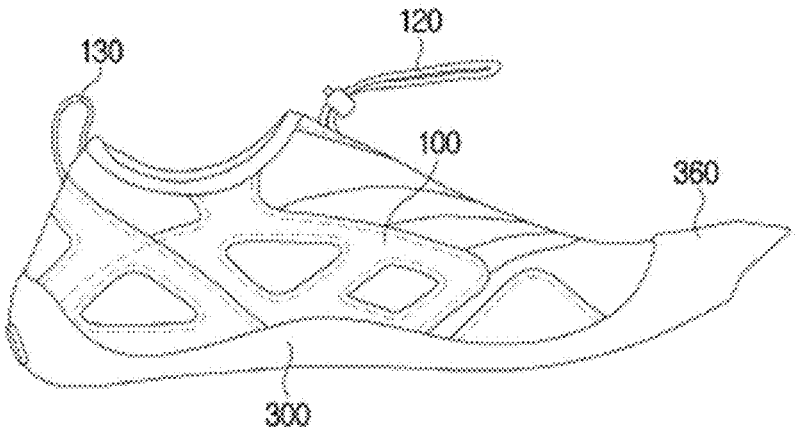
FIG. 3 is a side view illustrating a non-slip shoe with a webfoot according to the first example embodiment of the invention.

FIG. 3 is a side view illustrating a non-slip shoe with a webfoot according to the first example embodiment of the invention.

As described above, the upper part 100 is entirely wrapped around the foot, and the extension portion 130 at the heel portion and the tightening part 120 for tightening function can be further formed as described above.

The webfoot 360 is formed to extend integrally from the outsole 300. Here, there is a possibility that walking may be obstructed by the webfoot 360. Thus, if the end of the webfoot 360 comes into contact with the floor when forefoot is folded forward in the walking process, the webfoot 360 may disturb movement of the foot, so that length of the webfoot 360 is preferably relatively short in consideration of above problem. However, when the webfoot 360 is too short, force to push the water may be decreased. In consideration of this, the outsole 300 gradually raises from the forefoot to be separated from the floor so that efficiency of walking and swimming can be improved at the same time. The webfoot 360 is protruded in a shape having a greater inclination than the forefoot portion of the outsole 300. Thus, stepped shape at a portion where the webfoot 360 is formed as a whole is formed in a side view. The bottom surface of the webfoot 360 may be lowered toward the end portion.

Referring to FIG. 1, a plurality of slit-shaped grooves or protrusions in a front-rear direction is formed on the upper surface of the webfoot 360 to reduce the resistance. At least a rear side end portion may protrude upward from the upper surface of the upper part 100. When the upper part 100 is made of a mesh material in particular, the resistance is high, so that area of the upper surface of the upper part 100 which makes contact with the water flows along the upper surface of the webfoot 360 may be minimized by a vortex formed by the stepped shape at a portion where the upper part 100 and the upper surface of the webfoot 360 meet.

Figure 4:
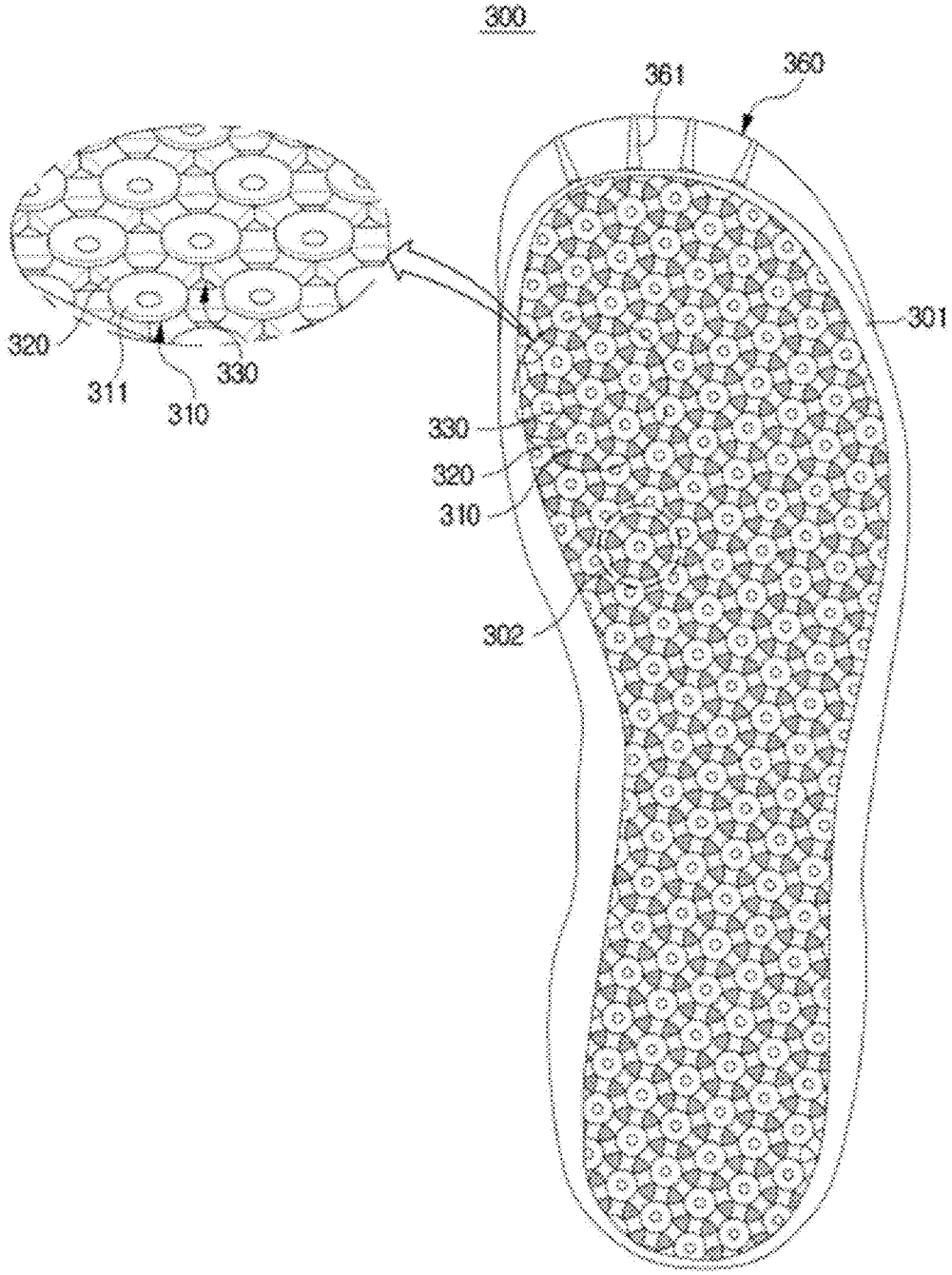
FIG. 4 is a bottom view illustrating a non-slip shoe with a webfoot according to a second example embodiment of the invention.

FIG. 4 is a bottom view illustrating a non-slip shoe with a webfoot according to a second example embodiment of the invention.

The suction portions 310 may be formed in a circular shape and may be connected to each other by a connecting portion 320 in a bottom view. An insole 200 and an opening portion 330 for discharging moisture from the insole 200 may be formed between the connecting portions 320.

An arrangement of the suction portion 310 and the connections 320 may be selective. It is appropriate that the suction portions 310 adjacent to one suction portion 310 are arranged in a regular hexagon considering uniform force of suction and response to various types and forms of shoes Thus, the connection portions 320 radially in outer circumferential six directions at even intervals are formed at the one suction portion 310. The suction portions 310 are respectively coupled to the each of the connection portions 320. The suction portions disposed to surround one suction portion are also connected to each other the connecting portion 320 so as to form one side of a regular hexagon.

According to this concept, six connection portions 320 are radially extended in one suction portion 310. Six suction portions can be arranged and one bottom unit 302 can be formed. Each of the suction portions 310 can form the bottom unit 302 at the center thereof, and adjacent bottom units 302 may have an intersection in a bottom portion.

A shape of the connecting portion 320 is selective, but it is preferable that a width of the connecting portion 320 increases as it approaches the suction portion 310.

In addition, the opening portion 330 between the connecting portions 320, may have a triangular shape when the three connection portions 320 are arranged in a substantially triangular shape.

The side wall portion 301 may be formed in the form of wrapping the outer periphery of the bottom surface of the outsole 300, and may form an outer frame on the bottom surface. Here, an outer side of the arrangement of the bottom units 302 is connected to the side wall portion 301. This form is preferably formed as a whole by an integral molding.

The connecting portion 302 is disposed to connect upper side of the suction portion 310. The suction portion 310 includes the cup portion 311 formed in an upwardly concave disc shape. The cup portion 311 forms a vacuum between the inner space and the floor to provide a suction force as described above.

The connecting portions 320 are flexibly deformed and warped so that the suction portions 310 are connected to each other to maintain their shape, and the connecting portions 320 maintain the shape of the suction portion 310 and flexibly change the shape of the bottom portion so that the suction force can be uniformly generated at the same time.

The opening portion 330 can function as temporary storage spaces that can contain a certain amount of moisture in contacting process so that excessive water layer is not generated between the floor and the cup portion 311 in the suction process.

Figure 5:
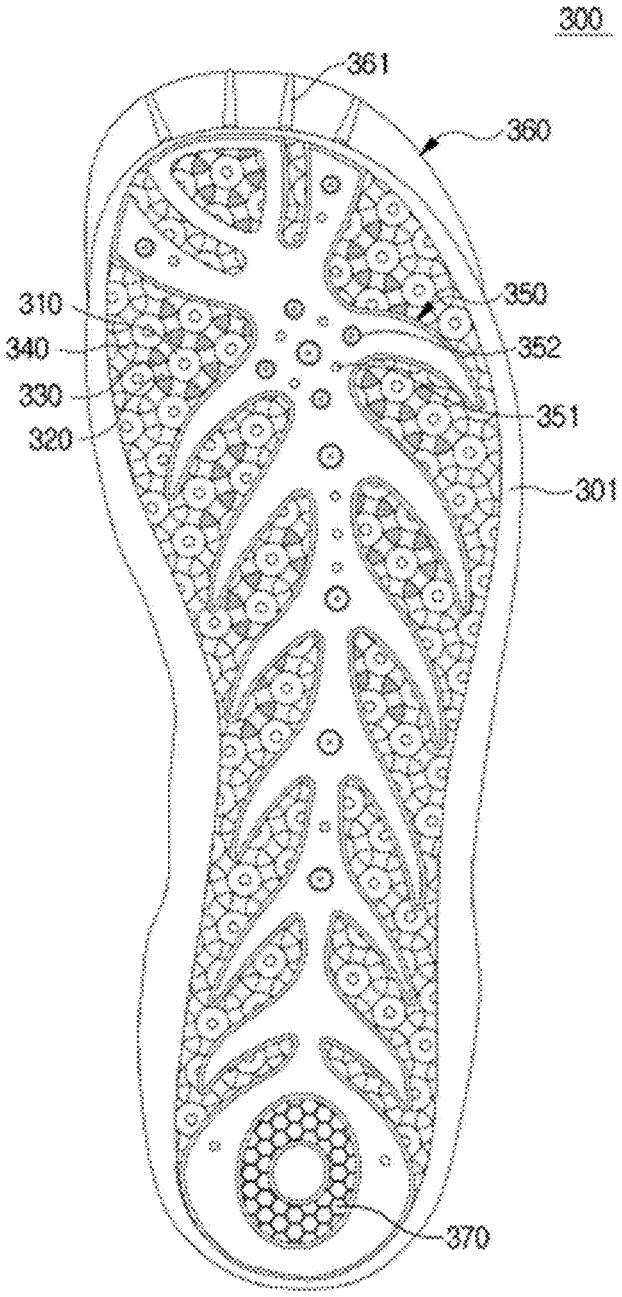
FIG. 5 is a bottom view illustrating a non-slip shoe with a webfoot according to a third example embodiment of the invention.

FIG. 5 is a bottom view illustrating a non-slip shoe with a webfoot according to a third example embodiment of the invention.

When the bottom units 302 are arranged as in the second embodiment and the opening portions 330 are formed between the connecting portions 320, flexibility may be provided, but there may be problems in stiffness and bearing capacity.

In view of this, in the third embodiment of the present invention, a structure, in which an inlay portion 350 as a reinforcing structure is further disposed to improve supporting force, is provided.

The inlay portion 350 may be formed so as to cross the front-rear direction of the bottom portion and have a predetermined branch portion extended to both sides thereof. The cup portions 311 in which the suction portion 310 or the friction portion 370 or the through hole 313 are formed may be arranged between the inlay portions 350.

It is preferable that the inlay portion 350 generally have a flat plate shape and a bottom surface of the inlay portion 350 has a height corresponding to the lower end of the cup portion 311 of the suction portion 310. Accordingly, the suction force can be smoothly provided in the suction portion 310 while the inlay portion 350 is compressed when the downward pressure is applied.

The inlay portion 350 may have a groove portion 351, which is one or more grooves, and a step portion 352 having a ring-shape, which is recessed upward. The groove portion 351 and the step portion 352 function to minimize the hydroplaning of the inlay portion 350 formed in a flat plate shape by providing a space where moisture can be temporarily stored.

In addition, it is preferable that the inlay part 350 corresponding to the heel portion where the greatest pressure is formed while being in contact with the floor firstly when walking is further include a friction portion 370 in which a plurality of protrusions are formed.

Meanwhile, in the present embodiment, the opening portion 330 and the filling portion 340 may be selectively arranged so as to fill the space between the connection portions 320, The filling part 340 can function to more firmly support connection relation of the connection parts 320 to improve the maintenance performance of the overall shape.

Although the arrangement of such opening portions 330 and filling part 340 may be optional, the opening portion 330 is preferably arranged adjacent to the inlay portion 350 In order to minimize hydroplaning and improve drainage, and the filling part 340 is preferably arranged adjacent to the side wall part 301 in order to secure rigidity.

As described above, the present invention can maximize utilization of so-called aqua-shoes in a place where water sports can be played, such as a swimming pool or a beach.

The webfoot 360 is formed to protrude forward of the outsole 300 and is secured to a predetermined area in front of which water can be pushed out during swimming.

In the above embodiments, the webfoot 360 is preferably formed as an integral injection structure together with the entire outsole 300.

Figure 6:
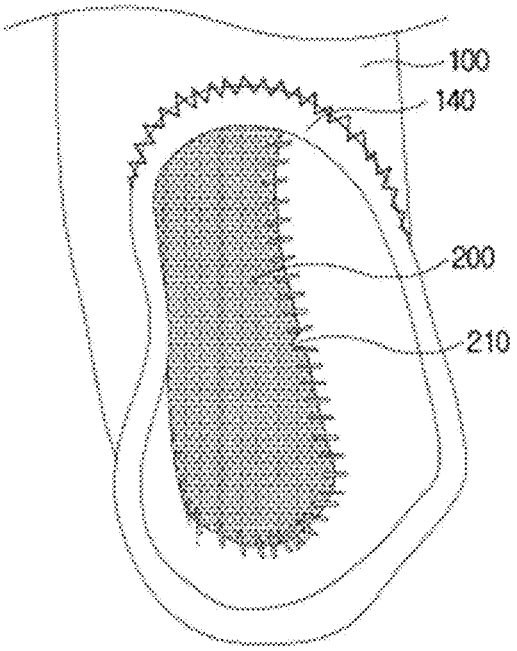
FIG. 6 is a plan view illustrating an opening portion side of a non-slip shoe with a webfoot according to an example embodiment of the invention.

FIG. 6 is a plan view illustrating an opening portion side of a non-slip shoe with a webfoot according to an example embodiment of the invention.

As described above, the upper part 100 and the insole 200 are connected to each other by removing the stepped portion by a method of Bonis sewing. A ring portion 140 is formed on the upper side of the upper part 100 so as to improve durability and feel in during inserting and removing the foot from the opening portion. The ring portion 140 may be combined to the upper part 100 by sewing.

In addition, the insoles 200 may be formed of a material having a mesh form and a plurality of voids in consideration of the drainage property. In this case, the water inside may be drained through the opening 330 and/or the through hole 313 of the outsole 300. An additional insole may further be disposed above for the purpose of improving buffering and feeling.

In the concept of the present invention, in order to improve the light weight and the rigidity of the coupling, the upper part 100 and the insole 200 are joined together in a sewing manner, and the bottom surface of the insole 200 is adhered to the outsole 300. And the lower outer surface of the upper part 100 is bonded to the inner surface of the side wall portion of the outsole 300.

The lower side of the upper part 100 is combined with the insole 200 in such a manner that it is sewn along the outer periphery of the insole portion 200. In a manufacturing of traditional shoe, a bottom portion corresponding to an insole is inverted while an inner surface of an upper part is turned upside down, an outer peripheral surface of a lower end of the upper part and an outer peripheral side of a bottom surface of a bottom portion are disposed to face each other and sewed. Turn the upper part back so that a stitching surface is not visible to outside.

In the traditional method of joining the upper part and the bottom portion, there is no problem in outer side finishing, but there is a problem in wearing comfort because the sewn edge portion protrudes from the inner side. Thus, there was a problem in wearing comfort and there was a fear of body damage to user's foot. In addition, the manufacturing process was also too complicated.

In the present invention, a joining method is proposed in which the upper part 100 and the insole 200 are sewn in Bonis sewing. Thus, edge of the lower end of the upper part 100 and outer edge of the insole 200 are disposed adjacent to each other, and then the adjoining regions on the plane are connected in a zigzag manner up and down through a sewing thread, so that the upper part 100 and the insole 200 can be joined together in a single sewing process. Here, the manufacturing process is simplified as compared with the traditional method, and since the step and the protruding portion are not formed at a connecting portion when worn on the foot, so that wearability is improved.

The connecting portion where the upper part 100 and the insole 200 are to be sewn is defined as a sewing portion 210. The sewing portion 210 is adhered to the inner circumferential side of the outsole 300 and is not exposed to the outside as will be described later.

On the other hand, since the insole 200 is in direct contact with bottom of the foot, a material having excellent wearing comfort can be adopted. Preferably, the insole 200 may be formed of a material having a plurality of voids in consideration of absorption of sweat and moisture or drainage property. For this purpose, it is preferable to be made of a synthetic fiber material having a mesh form, but it is not limited thereto. The mesh form can be varied in consideration of feeling of the foot and the performance of drainage or moisture absorption. Such a mesh form provides drainage together with the opening portion 330 of the outsole 300 and the through portion of the additional insole, as will be described later.

In the present invention, the outsole 300 and the upper part 100 and the insole 200 are bonded together, and it is formed of a lightweight material, so that improvement of the overall support performance by the outsole 300 should be considered.

As described above, the upper part 100 and the insole 200 are connected to each other by the sewing portion 210 having the same sewing method as that of the Bonis sewing with their corners adjacent to each other, and then a bonding material is applied to the bottom surface of the insole 200 and the lower outer circumference of the upper part 100. A joint portion 400 may be made of adhesive. In addition, the bonding material may be applied on the upper side of the outsole 300, or the bonding material may also be applied on the upper part 100 and the insole 200 and the outsole 300.

Accordingly, the insole 200 and the outsole 300, and the upper part 100 and the outsole 300 are coupled by the bonding material. In addition, connection of the insole 200 and the upper part 100 at the sewing portion 210 can be further strengthened. Here, since bonding portions are formed on the inner surfaces of the portions, so that the upper part 100 is bonded to each of the portions. [98] An additional insole may be disposed on the upper side of the insole 200 to improve shock absorbing performance and feeling. The additional insole may directly contact the bottom of the foot and may provide drainage performance.

[99] In addition, a reinforcing portion (not shown) to properly support the foot structure against repeated deformation may be combined to an outer surface of the upper part 100. The reinforcing portion may function as a predetermined skeleton so as to support a force in the front, back, or up and down directions while forming a predetermined pattern on the outer surface. The reinforcing portion may be previously formed as a synthetic resin material and sewed to the outer surface of the upper part 100, or adhered to, or fused to the outer surface of the upper part 100.

For example, the reinforcing portion forms a textile printing treatment surface on a surface of fibers constituting the upper part 100, and then the textile printing material is injected while the mold is covered. Here, when foamed ink is injected, it forms a three-dimensional shape and it may be formed through a process of forming a uniform thickness or a desired shape thickness through a press.

As described above, the non-slip shoes having the webfoot according to the present invention can simultaneously perform the functions of walking and swim, thereby improving the utility in the water and maximizing the convenience since the webfoot do not obstruct walking.

In addition, since the upper part, the insole, and the outsole are made of a lightweight material and the manufacturing process is minimized, the productivity can be improved and the shoes optimized for shape and motion of the foot can be provided.

In addition, safety can be improved by using suction force so as to prevent slipping on wet floor, and since the suction force can be released according to pressure change during the walking process, the convenience of use may be improved.

In the foregoing, the present invention has been described in detail based on the embodiments and the accompanying drawings. The foregoing is illustrative of the inventive concept and is not to be construed as limiting thereof. The inventive concept is defined by the following claims, with equivalents of the claims to be included therein.

The invention claimed is:

1. A non-slip shoe, comprising:

an upper part which covers an instep of a foot;

an insole connected to a lower side of the upper part;

an outsole combined with the insole and the upper part which is supported by a floor, the outsole having a front side and a rear side; and a webfoot which extends from the front side of the outsole, wherein the outsole comprises a plurality of suction portions each comprising a cup portion which is in close contact with the floor on an outer circumferential side, and is compressed and provides a suction force;

the outsole further comprises at least one friction portion formed lengthwise from the front side to the rear side;

the friction portion is spaced apart by two friction portions so as to divide a bottom surface of the outsole into three sections;

the suction portion disposed between the two friction portions includes a through hole formed on a center of the cup portion configured to discharge moisture inside to outside; and the suction portion disposed between one of the friction portions and a side wall of the outsole comprises a protrusion protruding downward from a center of the cup portion.

2. The non-slip shoe of claim 1, wherein the outsole gradually rises upwardly at a forefoot portion, and the webfoot rises upwardly further than the forefoot portion.

3. The non-slip shoe of claim 2, wherein the webfoot comprises a reinforcing rib which extends from a front of the outsole;

a plurality of the reinforcing rib which is a protrusion is formed by protruded downward from a bottom surface of the webfoot at predetermined intervals to divide space left and right to guide a flow of water backward; and a plurality of grooves or protrusions is formed laterally to guide the flow of water to sideward at a side surface of the reinforcing rib disposed on outermost side of the webfoot.

4. The non-slip shoe of claim 2, wherein a stepped shape is formed at the bottom surface of the webfoot toward the outsole where the bottom surface of the webfoot meets the outsole.

5. The non-slip shoe of claim 2, wherein the webfoot is formed such that a rear end of an upper surface of the webfoot protrudes higher than an upper surface of the upper part; and a stepped shape is formed where the upper part and the upper surface of the webfoot meet each other.

6. The non-slip shoe of claim 1, wherein the plurality of the suction portions each further comprises a protrusion protruding downward from a center of the cup portion.

7. The non-slip shoe of claim 6, wherein an outer periphery of the cup portion is disposed below lower end of the protrusion;

the outer periphery of the cup portion makes contact with the floor and is compressed so as to provide suction force when the cup portion makes contact with the floor; and the protrusion comes into contact with the floor, and the suction force of the cup portion is released as the pressure increases, when a foot load moves.

8. The non-slip shoe of claim 1, wherein the plurality of the suction portions each further comprises a through hole formed at a center of the cup portion and configured to discharge moisture inside to outside.

9. The non-slip shoe of claim 1, wherein the friction portion is formed to have drainage grooves in a zigzag form.

10. The non-slip shoe of claim 1, wherein the outsole comprises a connecting portion connecting upper sides of the suction portions with each other, and an opening portion formed between the connection portions.

* * * * *